US009332349B2

(12) United States Patent
Hagioka

(10) Patent No.: US 9,332,349 B2
(45) Date of Patent: May 3, 2016

(54) SOUND IMAGE LOCALIZATION APPARATUS

(71) Applicant: SONY MOBILE COMMUNICATIONS, INC., Minato-ku (JP)

(72) Inventor: Ryuichi Hagioka, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 384 days.

(21) Appl. No.: 13/871,519

(22) Filed: Apr. 26, 2013

(65) Prior Publication Data

US 2013/0294605 A1 Nov. 7, 2013

Related U.S. Application Data

(60) Provisional application No. 61/640,887, filed on May 1, 2012.

(51) Int. Cl.

| | |
|---|---|
| ***H04R 5/00*** | (2006.01) |
| ***H04R 1/10*** | (2006.01) |
| ***H04R 5/02*** | (2006.01) |
| ***H04S 5/00*** | (2006.01) |
| *H04S 3/00* | (2006.01) |

(52) U.S. Cl.

CPC .. *H04R 5/00* (2013.01); *H04S 5/00* (2013.01); *H04S 3/008* (2013.01); *H04S 2400/01* (2013.01); *H04S 2400/11* (2013.01); *H04S 2420/01* (2013.01)

(58) Field of Classification Search

CPC ..... H04S 2420/01; H04S 2400/01; H04S 2400/03; H04S 2400/11; H04S 3/008; H04S 5/00; H04R 5/00

USPC ..... 381/17, 310, 74; 700/94

See application file for complete search history.

(56) References Cited

U.S. PATENT DOCUMENTS

| | | | | |
|---|---|---|---|---|
| 2006/0198527 | A1* | 9/2006 | Chun | 381/17 |
| 2010/0054483 | A1* | 3/2010 | Mizuno et al. | 381/17 |

FOREIGN PATENT DOCUMENTS

| | | |
|---|---|---|
| JP | 2002-209300 | 7/2002 |
| JP | 2009-010995 | 1/2009 |

* cited by examiner

*Primary Examiner* — Vivian Chin
*Assistant Examiner* — Douglas Suthers
(74) *Attorney, Agent, or Firm* — Oblon, McClelland, Maier & Neustadt, L.L.P.

(57) ABSTRACT

The present disclosure relates to a sound image localization apparatus that includes head related transfer function (HRTF) filters that receive a monaural audio signal and generate a first channel output signal using a first head related transfer function describing a change in sound at right/left eardrum caused when a sound occurs from a first direction; low-pass filters that cut high frequency components of the monaural audio signal and pass low frequency components of the monaural signal; delay circuits that delay an output of the low-pass filters by first/second delay amount; and mixers that mix an output of the HRTF filters and an output of the delay circuits and output an audio signal.

15 Claims, 9 Drawing Sheets

FIG. 6

| | 301 (C) | 302 (FL) | 303 (FR) | 304 (BL) | 305 (BR) |
|---|---|---|---|---|---|
| $\theta$ | $\theta$c ( 0°) | $\theta$fl ( 30°) | $\theta$fr ( -30°) | $\theta$bl ( 110°) | $\theta$br ( -110°) |
| dL | dLc | dLfl | dLfr | dLbl | dLbr |
| dR | dRc | dRfl | dRfr | dRbl | dRbr |
| D0 | d0 | d0 | d0 | d0 | d0 |

SOUND IMAGE LOCALIZATION APPARATUS

CROSS REFERENCE TO RELATED APPLICATION

The present application claims the benefit of the earlier filing date of U.S. Provisional Patent Application Ser. No. 61/640,887 filed on May 1, 2012, the entire contents of which is incorporated herein by reference.

BACKGROUND

1. Field of the Disclosure

The present disclosure relates to a sound image localization apparatus and a sound image localization method using head related transfer function (HRTF), and to a virtual surround system.

2. Description of Related Art

Many sound field representing techniques that allow a listener who listens to a certain sound with a stereophonic electroacoustic transducer such as a headphone to perceive, with filtering processing, the sound as if the listener were hearing the sound in an arbitrary space have been proposed. Among these sound field representing techniques, as an advantageous method at present, there is a technique, which measures an HRTF at the position of the ear drum and designs filter parameters using the HRTF. When a sound occurs from a particular direction, an HRTF describes a change in sound at the eardrum, which is caused by an object near the eardrum, such as the pinna, head, or shoulder, as a transfer function. A filter is designed using the HRTF, and, when sound is filtered using this HRTF filter, the sound can be perceived as if it were heard from the particular direction. Such processing is called sound image localization processing.

Also, as an apparatus that uses a sound field representing technique, there is a virtual surround system, which downmixes, with a plurality of sound image localization processes, multichannel sound to stereophonic sound without losing surround effects.

SUMMARY

However, there is a problem that, when HRTF filtering that represents sound image localization using HRTF is performed, the volume at low frequencies is heard to be small, compared with the original sound. Also, there is a problem that only a small sound image localization effect can be expected at low frequencies. Thus, there is room for improvement in realism of a virtual surround system using sound image localization processing that utilizes HRTF filters.

The inventor recognizes the necessity to improve the volume and sound image localization effect at low frequencies in sound image localization processing that utilizes HRTF filters.

According to an embodiment of the present disclosure, there is provided a sound image localization apparatus that includes first and second HRTF filters that individually receive a monaural audio signal and generate first and second channel output signals that enable sound to be heard from a particular direction; a first low-pass filter that cuts high frequency components of the monaural audio signal and passes low frequency components; a first delay unit that delays an output of the first low-pass filter by a first delay amount; a second low-pass filter that cuts high frequency components of the monaural audio signal and passes low frequency components; a second delay unit that delays an output of the second low-pass filter by a second delay amount; a first mixer that mixes an output of the first HRTF filter and an output of the first delay unit and outputs a first channel audio signal; and a second mixer that mixes an output of the second HRTF filter and an output of the second delay unit and outputs a second channel audio signal, wherein a difference between the first and second delay amounts is set on the basis of the particular direction.

In this configuration, with the first and second HRTF filters, the sense of localization which enables the sound to be heard from the particular direction can be achieved, and, at low frequencies, the sense of localization at low frequencies is improved in accordance with a time difference which corresponds to the difference in the delay amounts of the first and second delay units.

In this configuration, the apparatus may further include third and fourth delay units that add a same certain delay amount to the first and second delay amounts. Accordingly, the sense of localization in front, back, up, and down directions of the listener is improved.

According to the following embodiments of the present disclosure, a virtual surround system is also described. This virtual surround system generates a virtual multichannel audio output signal by combining a plurality of sound image localization apparatuses for a plurality of different directions as the specific direction, and virtually realizes a surround effect with a stereophonic electroacoustic transducer.

The present disclosure can also be understood as a sound image localization method, a computer program for sound image localization, and a computer-readable recording medium that has stored therein the computer program.

BRIEF DESCRIPTION OF DRAWINGS

FIG. 6 is a diagram illustrating parameters of sound image localization apparatuses in the individual directions (individual channels) in FIG. 5.

DETAILED DESCRIPTION

Hereinafter, embodiments of the present disclosure will be described with reference to the drawings.

Figure 1:
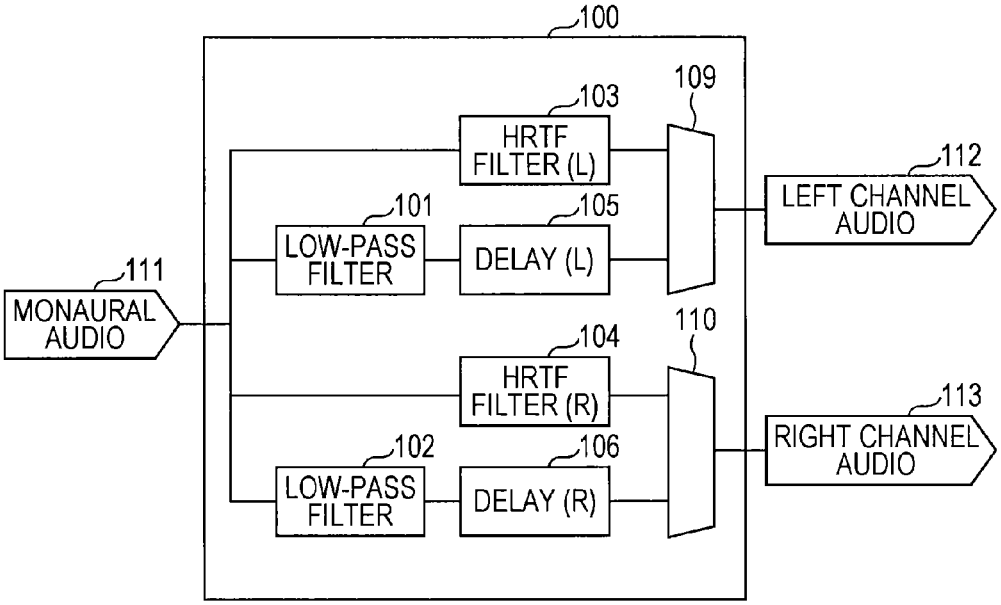
FIG. 1 is a functional block diagram with main function parts constituting a sound image localization apparatus according to an embodiment of the present disclosure.

FIG. 1 shows a functional block diagram with main function parts constituting a sound image localization apparatus 100 according to a present embodiment.

The sound image localization apparatus 100 includes first and second low-pass filters 101 and 102, first and second HRTF filters (L, R) 103 and 104, first and second delay units (L, R) 105 and 106, and first and second mixing units (mixers) 109 and 110.

The first and second HRTF filters 103 and 104 are function units that receive a monaural audio signal 111 and generate first and second channel output signals, respectively, as if the sound were heard from a specific direction.

The first and second low-pass filters 101 and 102 are function units that cut high frequency components of the monaural audio signal 111 and pass low frequency components.

The first delay unit 105 is a function unit that delays an output of the first low-pass filter 101 by a first delay amount (t1). The second delay unit 106 is a function unit that delays an output of the second low-pass filter 102 by a second delay amount (t2).

The first mixing unit (mixer) 109 is a function unit that mixes an output of the first HRTF filter 103 and an output of the first delay unit 105 and outputs an audio signal 112 for a first channel (left channel in this example). The second mixing unit (mixer) 110 is a function unit that mixes an output of the second HRTF filter 104 and an output of the second delay unit 106 and outputs an audio signal 113 for a second channel (right channel in this example).

Various function units shown in FIG. 1 may be configured as hardware or realized by software processing.

A difference Δt between the first delay amount (t1) of the delay unit 105 and the second delay amount (t2) of the delay unit 106 is set on the basis of a particular direction of a sound source assumed by the sound image localization apparatus 100. For example, when t1=t2=t0, the binaural time difference Δt=t1−t2=0. The delay amount t0 is set so that the outputs of the delay units 105 and 106 in the case of the delay amount t0 are synchronized with, that is, identical in terms of time with, the outputs of the HRTF filters 103 and 104. When Δt is not 0, such as when t1>t2, t1=t0+Δt/2, and t2=t0−Δt/2. When t1<t2, t1=t0−Δt/2, and t2=t0+Δt/2.

With the sound image localization apparatus 100 in this manner, sounds that have been HRTF-filtered and low-frequency sounds that have been delayed are mixed by the mixing units 109 and 110 and are output as the left and right audio signals 112 and 113.

Figure 2:
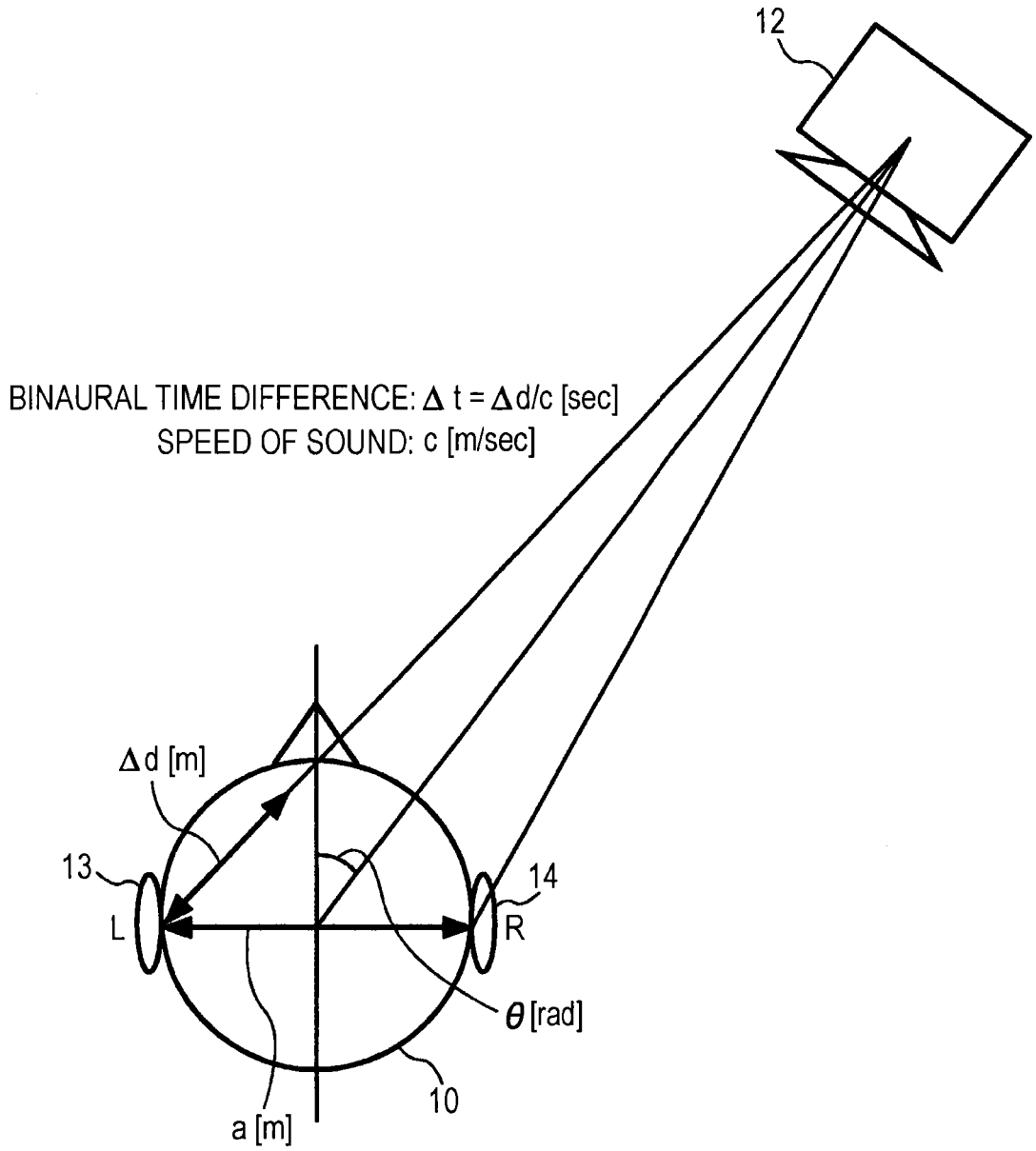
FIG. 2 is a diagram for describing a binaural time difference.

Δt this point, the binaural time difference is adjusted by causing the delay amounts t1 and t2 of the delay units 105 and 106 to have a difference. In this way, a low frequency sound can be given the sense of sound image localization. The binaural time difference is a time difference caused by a difference Δd in channel length until a sound emitted from a sound source 12 reaches the left and right ears, as shown in FIG. 2. A time difference model has been proposed which approximately obtains a binaural time difference on the basis of the size a[m] of the head 10 of a user (listener), the direction of the sound source 12 seen from the user, and the speed of sound. For example, a time difference model proposed by Woodworth, Schlosberg, et al. gives the following approximate expression:

$$\Delta t = \Delta d / c$$

$$= a(\sin\theta + \theta)/c \ (-\pi < \theta < \pi)[\text{sec}]$$

wherein Δd[m] denotes the difference between channels (distances) from the sound source 12 to the left and right ears 13 and 14, a[m] denotes the distance between the two ears (width of the head 10), θ denotes the direction of the sound source 12 seen from the user, and c[m/sec] denotes the speed of sound.

By using such a time difference model, the binaural time difference when there is the sound source 12 in an arbitrary direction can be approximately obtained. That is, the binaural time difference Δt when there is the sound source 12 in a particular direction is obtained with this approximate expression, and the binaural time difference Δt is represented by causing the left and right channels to have delays, thereby adding the sense of sound image localization to low frequency sound.

In the present embodiment, the binaural time difference for low frequency sound is represented by the delay units 105 and 106 in FIG. 1, and the sense of sound image localization is added to the low frequency sound. The direction of localization added here coincides with the direction of localization given by the HRTF filters 103 and 104. Accordingly, low frequency sound to which the sense of localization is added based on the binaural time difference and sound that has been subjected to HRTF filter processing have the sense of sound image localization in similar directions. Therefore, when these audio signals are mixed, the volume at low frequencies can be supplemented without losing the sense of sound image localization given by the HRTF filters 103 and 104.

Figure 3:
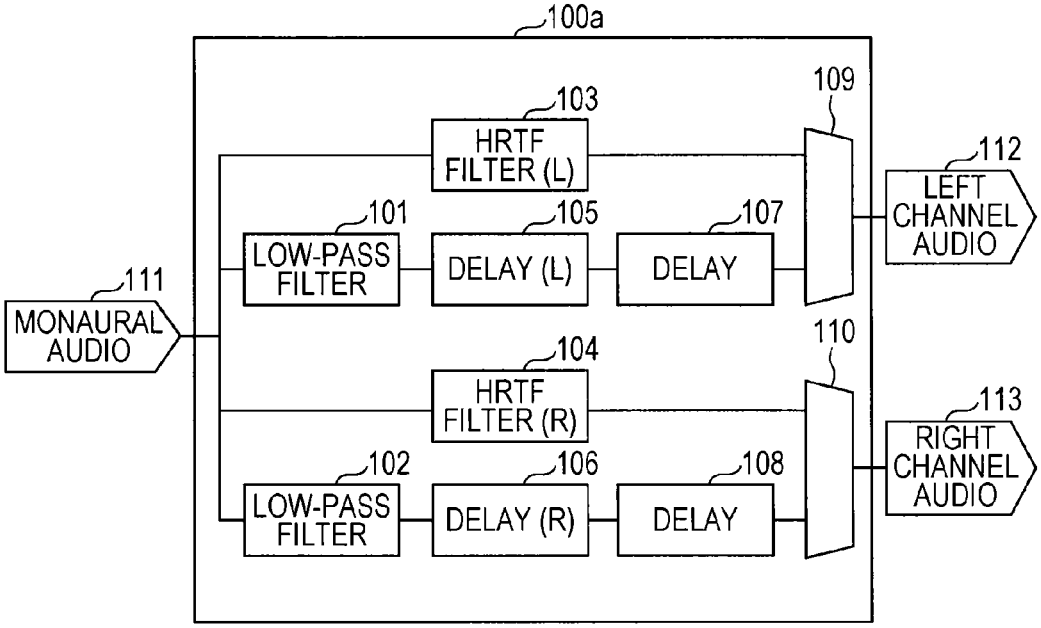
FIG. 3 is a functional block diagram with main function parts constituting a sound image localization apparatus according to a second embodiment of the present disclosure.

FIG. 3 is a functional block diagram with main function parts constituting a sound image localization apparatus 100*a* according to a second embodiment of the present disclosure. Function units that are the same as the function units shown in FIG. 1 are given the same reference numerals, and overlapping descriptions are omitted.

In the second embodiment, different delay units 107 and 108 are added subsequent to the delay units 105 and 106. That is, the delay unit 107 is arranged between the delay unit 105 and the mixing unit 109, and the delay unit 108 is arranged between the delay unit 106 and the mixing unit 110. The delay units 107 and 108 constitute third and fourth delay units that individually add the same certain delay amount (for example, about 10 msec) to the first and second delay amounts.

Note that, although the third and fourth delay units 107 and 108 are shown as independent function units that are different from the first and second delay units 105 and 106, the third and fourth delay units 107 and 108 are equivalent to that in which the delay amounts of the first and second delay units 105 and 106 are increased. In that case, the first and third delay units 105 and 107 may be configured as a single delay unit. Similarly, the second and fourth delay units 106 and 108 may be configured as a single delay unit.

In the second embodiment, the sense of sound image localization is further improved by delaying, of the output sound of the HRTF filter 103, low frequency sound with the delay unit 107 and, of the output sound of the HRTF filter 104, low frequency sound with the delay unit 108. Although HRTF filters can generate the sense of sound image localization in the front, back, left, right, up, and down directions, the effects thereof are weak at low frequencies. Also, sound image localization based on the binaural time difference using the delay units 105 and 106 cannot localize sound in up and down directions. To solve these problems, the Haas effect is utilized, which is an effect that, when the listener hears the same sound from different directions, the listener feels that localization is biased to the direction of a sound source of the firstly heard sound. That is, low frequency sound that is given a binaural time difference is delayed by a certain delay amount with respect to sound that has been subjected to HRTF filter processing, thereby causing the listener to feel that localization is biased to the direction of a sound source represented by the HRTF filter processing. Accordingly, the sense of sound image localization can be improved in front, back, up, and down directions.

According to the second embodiment as has been described above, low frequency sound is extracted, the binaural time difference is adjusted, and the Haas effect is utilized, thereby supplementing the volume at low frequencies of sound that has been subjected to HRTF filter processing and further improving the sound image localization effect.

Figure 4:
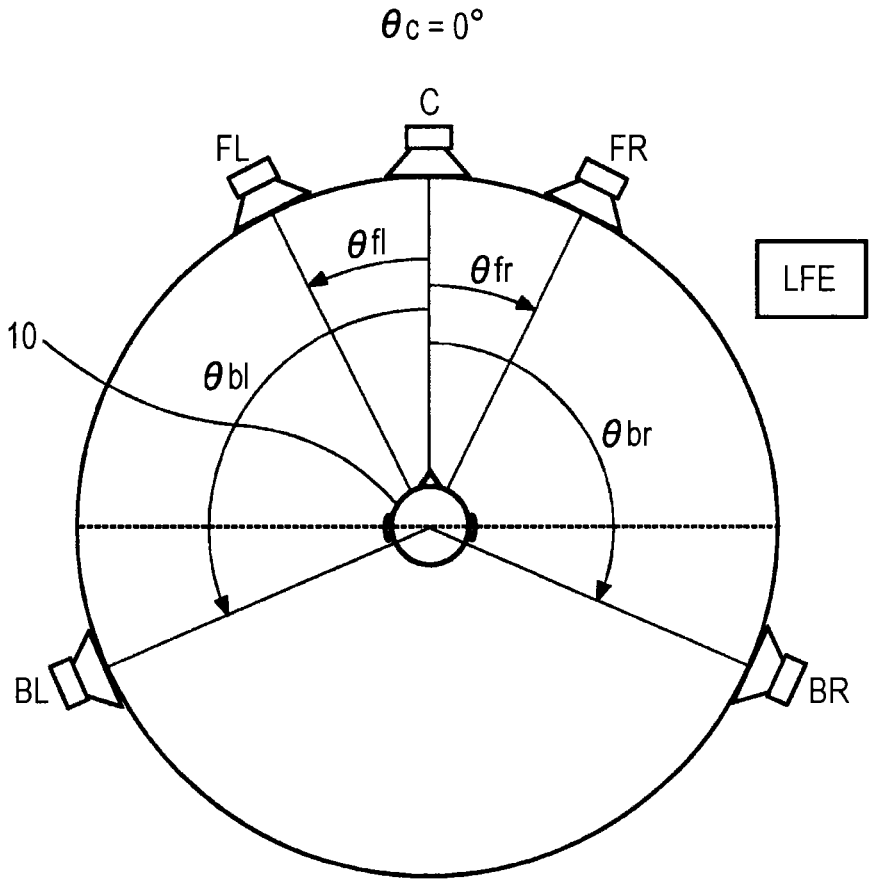
FIG. 4 is a diagram showing a virtual surround system that is virtually constructed using a plurality of sound image localization apparatuses according to an embodiment of the present disclosure.

FIG. 4 shows a surround system with the arrangement of multichannel loudspeakers with reference to the listener. In a present embodiment, such a virtual surround system is structured by utilizing a plurality of sound image localization apparatuses 100 or 100*a* shown in FIG. 1 or 3. The virtual surround system in the present embodiment is a virtual system that uses a plurality of sound image localization apparatuses for multichannel audio signals, and downmixes multichannel sound that occurs therefrom to stereophonic sound as if there were sound sources in a plurality of directions.

Figure 5:
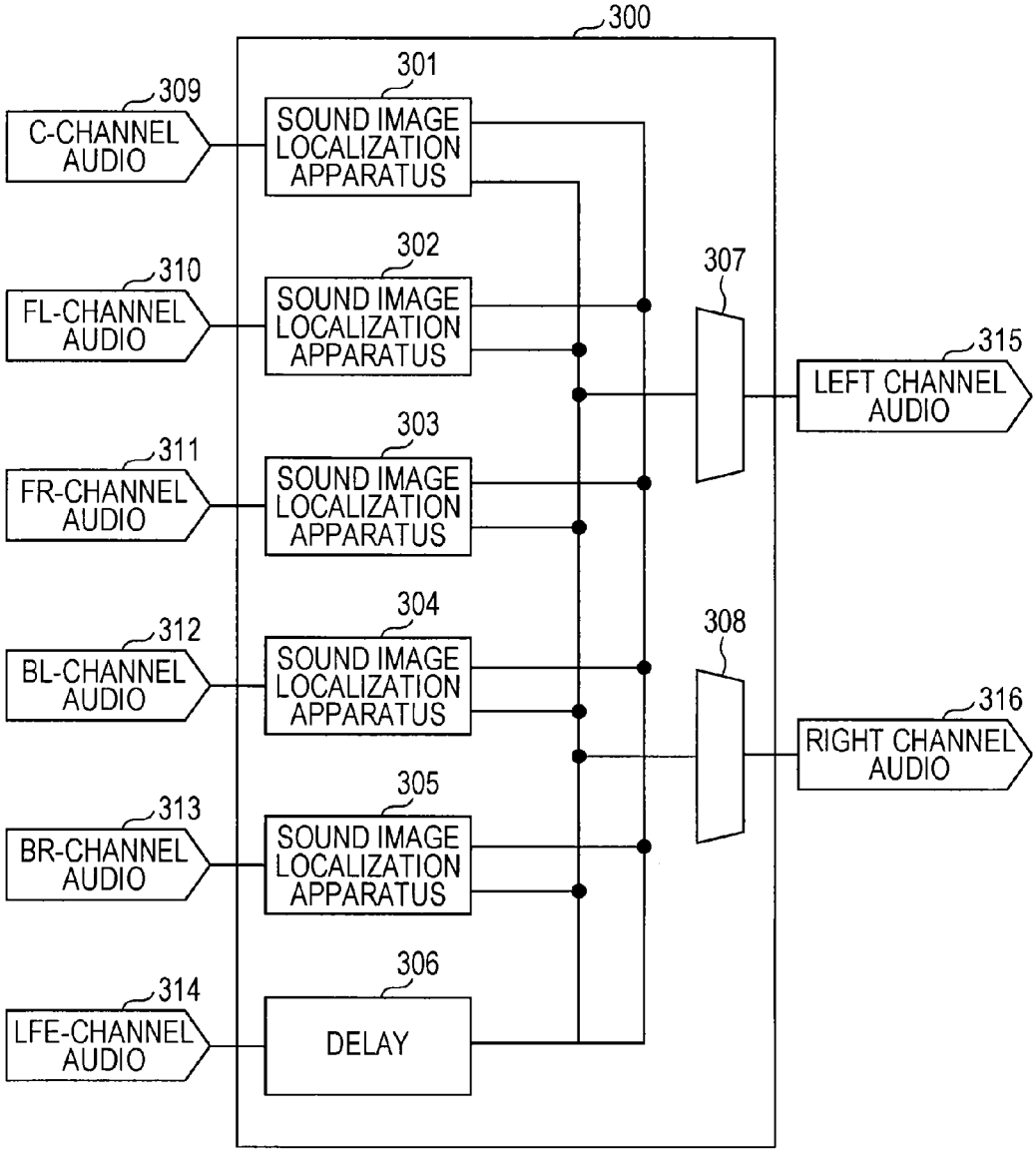
FIG. 5 is a diagram showing an example of the configuration of the interior of a 5.1-ch surround system serving as an example of the virtual surround system.

FIG. 5 shows an example of the configuration of the interior of a 5.1-ch surround system 300 as an example of the virtual surround system. In the actual 5.1-ch surround system, six loudspeakers are used. These six loudspeakers include a loudspeaker C in front of the listener, a front right loudspeaker FR, a front left loudspeaker FL, a back right loudspeaker BR, a back left loudspeaker BL, and a subwoofer loudspeaker LFE (low frequency effect) for low frequency output. In the diagram, the direction of the right ear of the listener serves as the reference direction, and the directions of the individual loudspeakers (sound sources) are denoted as θc, θfr, θfl, θbr, and θbl. Although the location of the loudspeaker LFE is not specifically restricted, the loudspeaker LFE is generally arranged in front of the listener at a listening position (in the diagram, the location of the loudspeaker LFE is not restricted, and the loudspeaker LFE is illustrated in margin). Because the output frequencies of the subwoofer loudspeaker LFE are limited, the subwoofer loudspeaker LFE is expressed as 0.1 ch. In the virtual surround system, among these six loudspeakers, the above-described sound image localization apparatuses are used as 5-ch loudspeakers. In this way, the surround system is actually realized by two loudspeakers.

Audio data 309, 310, 311, 312, and 313 of the individual channels extracted from 5.1-ch surround audio data are input to sound image localization apparatuses 301, 302, 303, 304, and 305 that are equivalent to the above-described sound image localization apparatus 100 or 101*a*. Left channel audio signals generated by these sound image localization apparatuses are mixed by a mixing unit 307, and a resultant signal is output as an L-channel signal 315 to an L-channel input terminal of a stereophonic electroacoustic transducer, such as a headphone or an earphone. Similarly generated R-channel audio signals are mixed by a mixing unit 308, and a resultant signal is input as an R-channel signal 316 to an R-channel input terminal of the electroacoustic transducer. Because the sound source direction of the LFE channel is generally not specified, LFE channel data 314 is delayed by a delay unit 306 by a delay amount (the above-described t0) that occurs by sound image localization processing. That is, the LFE channel audio data 314 is input via the delay unit 306 to the two mixing units 307 and 308.

FIG. 6 illustrates parameters of the sound image localization apparatuses 301 to 305 of the individual directions (individual channels) shown in FIG. 5. In this example, with reference to the front direction of the listener as the reference direction (0°) and the anti-clockwise direction seen from above the head as the forward direction, the directions of the sound image localization apparatuses 301 to 305 are assumed to be θc (0°), θfl (30°), θfr (−30°), θbl (110°), and θbr (−110°), respectively. Delay amounts dL of the individual delay units 105 of the sound image localization apparatuses 301 to 305 are assumed to be dLc, dLfl, dLfr, dLbl, and dLbr, respectively. Delay amounts dR of the individual delay units 106 of the sound image localization apparatuses 301 to 305 are assumed to be dRc, dRfl, dRfr, dRbl, and dRbr, respectively. Delay amounts D0 of the individual delay units 107 and 108 of the sound image localization apparatuses 301 to 305 are assumed to be a common d0.

For the sound image localization apparatus 301 of the channel C, dLc=dRc. For the sound image localization apparatus 302 of the channel FL, dLfl<dRfl. For the sound image localization apparatus 303 of the channel FR, dLfl>dRfl. For the sound image localization apparatus 304 of the channel BL, dLbl<dRbl. For the sound image localization apparatus 305 of the channel BR, dLbr>dRbr.

With the virtual surround system with such a configuration, the sense of localization as if the individual channel sounds of 5.1 ch were heard from the direction of a certain sound source can be achieved. By mixing the left channel sounds and the right channel sounds output from the individual sound image localization apparatuses and the LFE channel using the mixing units 307 and 308, the listener can feel the surround effect even though the listener is listening with a stereophonic electroacoustic transducer such as a stereophonic headset. Although the system configuration itself is the same as the existing method, because low frequencies are supplemented and the sense of localization is improved with the above-described sound image localization apparatuses, a sense of reality higher than that obtained with the existing method can be achieved.

Figure 7:
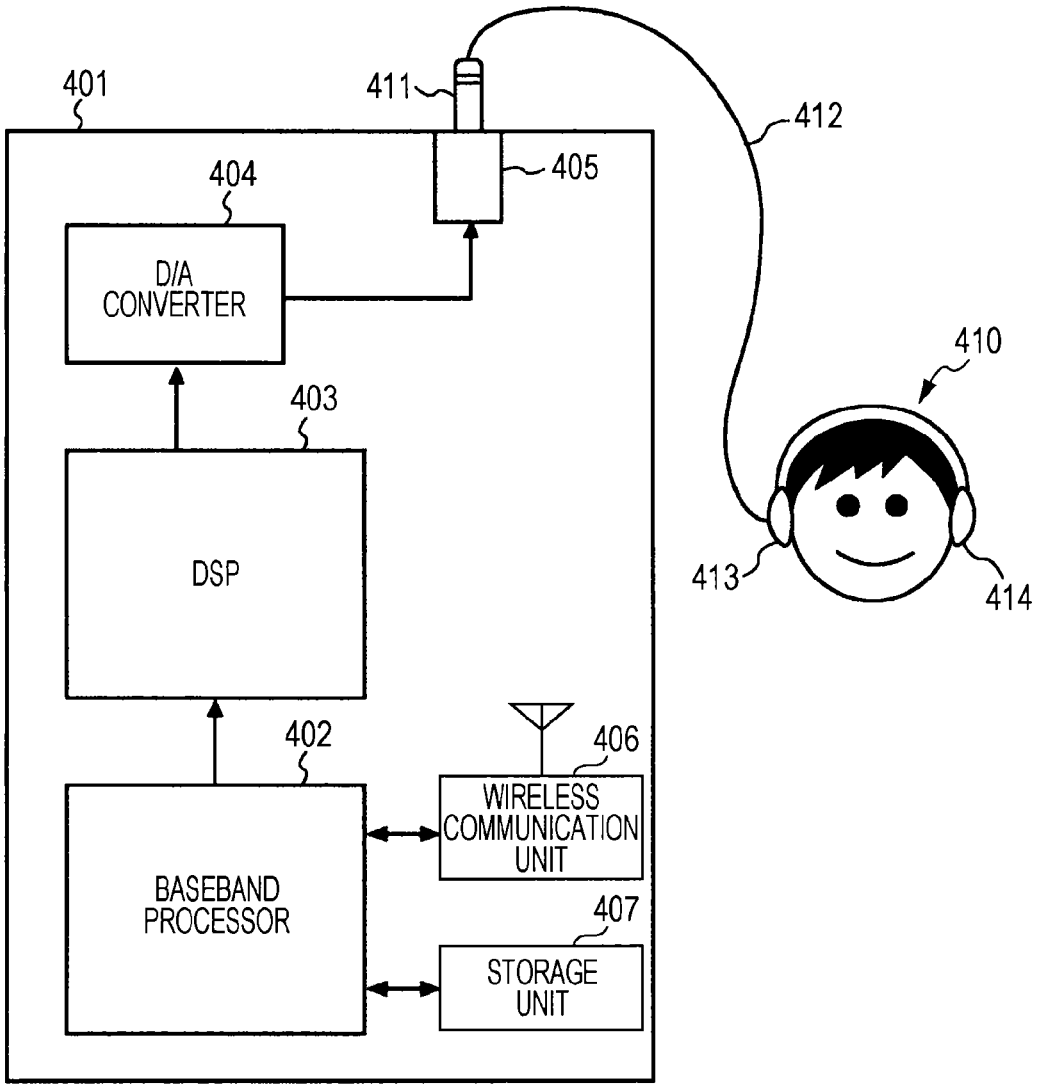
FIG. 7 is a diagram showing an example of the configuration of a mobile terminal adopting the virtual surround system according to the embodiment of the present disclosure.

FIG. 7 shows an example of the configuration of a mobile terminal 401 that functions as the virtual surround system according to the present embodiment. The mobile terminal 401 includes a baseband processor 402, a digital signal processor (DSP) 403, a digital analog (D/A) converter 404, an audio jack (connector) 405, a wireless communication unit 406, and the like. The wireless communication unit 406 may include, though not particularly limited to, for example, a communication unit (3G, 4G, etc.) of a mobile phone, a wireless LAN, and Bluetooth (registered trademark). A storage unit 407 is, for example, a non-volatile memory. The mobile terminal 401 may further include devices for conversation, such as a microphone and an ear receiver (not shown).

With the baseband processor 402, an audio file stored in the storage unit 407 is decoded, and 5.1-ch surround audio data is extracted and input to the DSP 403. An audio file may be downloaded (received) from the outside via the wireless communication unit 406. Alternatively, an audio file may be read from a removable recording medium (not shown) and may be utilized.

For the audio data of the individual channels of 5.1 ch, the DSP 403 executes sound image localization processing or the like, which has been packaged by software, and generates L-channel and R-channel audio data. These pieces of audio data are converted by the D/A converter 404 to L-channel and R-channel analog audio signals. A plug 411 of a stereophonic headset 410 is connected to the audio jack 405. The L-channel and R-channel analog audio signals are output via the audio jack 405, the plug 411, and a cable 412 to left and right loudspeakers 413 and 414 of the stereophonic headset (headphone) 410. A stereophonic ear phone may be used instead of the stereophonic headset 410.

Figure 8:
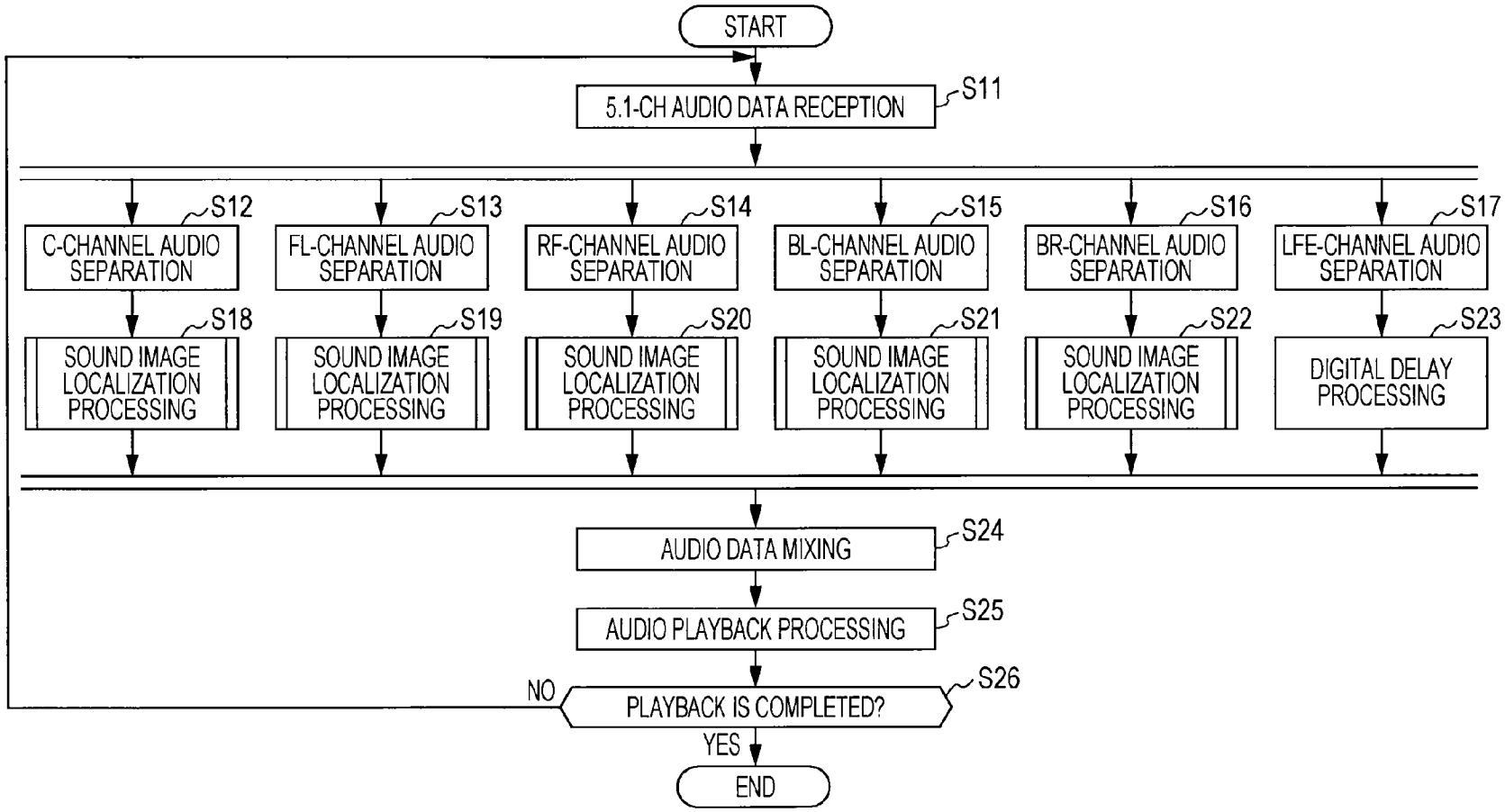
FIG. 8 is a flowchart showing a specific processing example of a DSP shown in FIG. 7.

FIG. 8 shows a specific processing example of the DSP 403.

The DSP 403 receives 5.1-ch surround audio data (S11) and separates the audio data into pieces of audio data of the individual channels (S12 to S17). Next, the DSP 403 executes sound image localization processing of the audio data of the individual channels, namely, C, FL, RF, BL, and BR (S18 to S22). The DSP 403 executes digital delay processing of the LFE channel audio data (S23). The DSP 403 mixes the sound-image-localized sounds and the digitally delayed sound (S24) and plays and outputs the mixed sound as stereophonic audio data (S25). Until playback is completed (S26), the DSP 403 returns to step S11, and the above-described processing is repeatedly executed.

Figure 9:
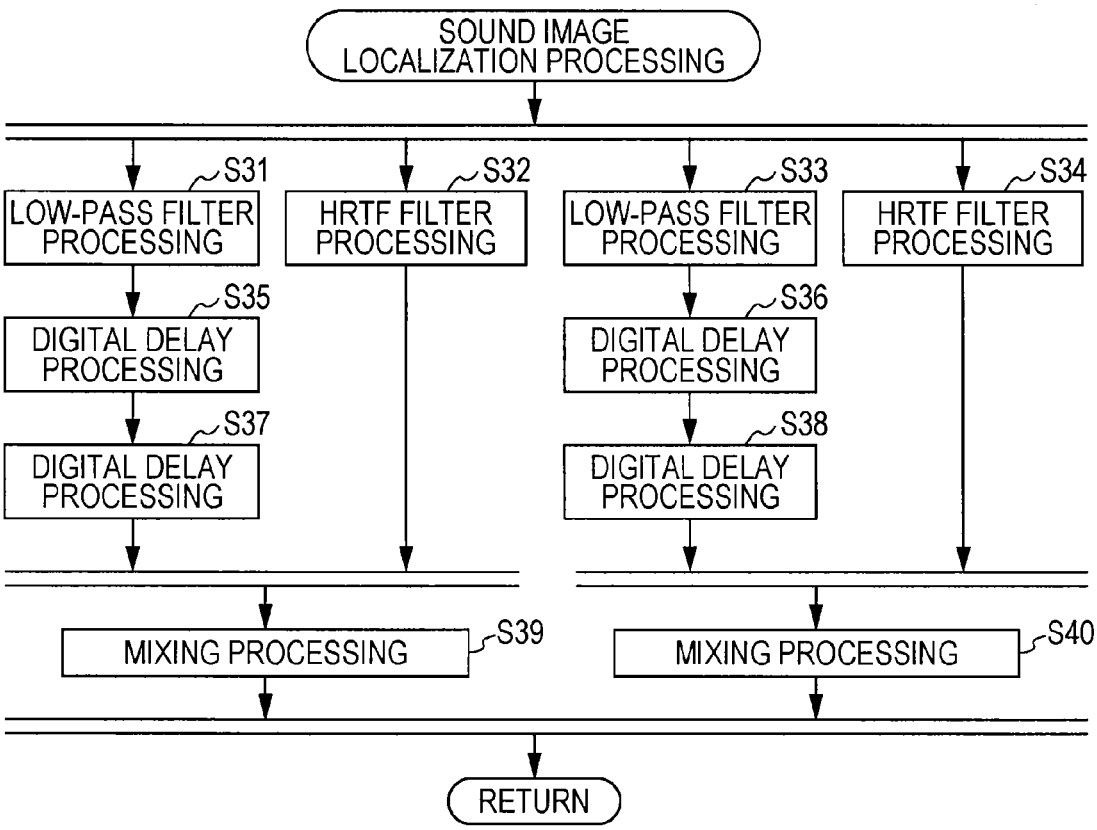
FIG. 9 is a flowchart showing a specific processing example of sound image localization processing shown in FIG. 8.

FIG. 9 shows a specific processing example of sound image localization processing. This sound image localization processing corresponds to the sound image localization apparatus 100*a* shown in FIG. 3, and the various function parts thereof are realized as low-pass filter processing, HRTF filter processing, digital delay processing, and mixing processing. Here, low-pass filters and HRTF filters are implemented as digital filters such as FIR filters.

For audio data of a single channel, the sound image localization processing executes low-pass filter processing S31 and HRTF filter processing S32 for the left channel and low-pass filter processing S33 and HRTF filter processing S34 for the right channel. Further, the sound image localization processing executes two-stage digital delay processing S35 and S37 of the output of the low-pass filter processing 31. The digital delay processing S35 and S37 corresponds to the delay units 105 and 107 shown in FIG. 3. Similarly, the sound image localization processing executes two-stage digital delay processing S36 and S38 of the output of the low-pass filter processing S33. The digital delay processing S36 and S38 corresponds to the delay units 106 and 108 shown in FIG. 3.

The output of the digital delay processing S37 and the output of the HRTF filter processing S32 are mixed in mixing processing S39. Similarly, the output of the digital delay processing S38 and the output of the HRTF filter processing S34 are mixed in mixing processing S40.

A virtual surround system has been described, which generates a virtual multichannel audio output signal by combining a plurality of sound image localization apparatuses for a plurality of different directions as the specific direction, and virtually realizes a surround effect with a stereophonic electroacoustic transducer.

Although the preferred embodiments of the present disclosure have been described above, various modifications and changes can be made other than those that have been described above. That is, it should be understood by those skilled in the art that various alterations, combinations, and other embodiments may occur depending on design requirements and other factors insofar as they are within the scope of the appended claims of the equivalents thereof.

A recording medium that stores, in a computer-readable format, a computer program for realizing the functions described in the above-described embodiments with a computer is also included in the disclosure of the present application. Examples of "recording media" for providing the program include, for example, magnetic storage media (a flexible disk, hard disk, magnetic tape, and the like), optical discs (magneto-optical discs such as MO and PD, CD, DVD, and the like), a semiconductor storage, and a paper tape.

The invention claimed is:

1. An information processing apparatus, comprising:

a sound image localization apparatus including:

a first head related transfer function (HRTF) filter configured to receive a monaural audio signal and generate a first channel output signal using a first head related transfer function describing a change in sound at a right eardrum caused when a sound occurs from a first direction;

a second HRTF filter configured to receive the monaural audio signal and generate a second channel output signal using a second head related transfer function describing a change in sound at a left eardrum caused when a sound occurs from the first direction;

a first low-pass filter configured to cut high frequency components of the monaural audio signal and pass low frequency components of the monaural signal;

a first delay circuit configured to delay an output of the first low-pass filter by a first delay amount;

a second low-pass filter configured to cut high frequency components of the monaural audio signal and pass low frequency components of the monaural signal;

a second delay circuit configured to delay an output of the second low-pass filter by a second delay amount;

a first mixer configured to mix an output of the first HRTF filter and an output of the first delay circuit and output a first audio signal; and a second mixer configured to mix an output of the second HRTF filter and an output of the second delay circuit and output a second audio signal, wherein a difference between the first delay amount and the second delay amount is set such that a second direction of localization caused by the difference between the first delay amount and the second delay amount coincides with the first direction of the first HRTF filter and the second HRTF filter.

2. The information processing apparatus of claim 1, wherein the sound image localization apparatus further includes a third delay circuit configured to delay an output of the first delay circuit by a third delay amount.

3. The information processing apparatus of claim 2, wherein the sound image localization apparatus further includes a fourth delay circuit configured to delay an output of the second delay circuit by a fourth delay amount.

4. The information processing apparatus of claim 3, wherein the first mixer is configured to mix an output of the first HRTF filter and an output of the third delay circuit and output the first channel audio signal; and the second mixer is configured to mix an output of the second HRTF filter and an output of the fourth delay circuit and output the second channel audio signal.

5. The information processing apparatus of claim 1, further comprising:

a second sound image localization apparatus configured to receive a second monaural audio signal and output a third audio signal and a fourth audio signal.

6. The information processing apparatus of claim 5, further comprising:

a third mixer configured to mix the first audio signal and the third audio signal and output a fifth audio signal; and a fourth mixer configured to mix the second audio signal and the fourth audio signal and output a sixth audio signal.

7. The information processing apparatus of claim 6, further comprising:

a third delay circuit configured to receive a third monaural audio signal and delay an output of the third monaural signal by a third delay amount.

8. The information processing apparatus of claim 7, wherein the third mixer is configured to mix the first audio signal, the third audio signal, and the output of the third delay circuit and output the fifth audio signal; and the fourth mixer is configured to mix the second audio signal, the fourth audio signal, and the output of the third delay circuit and output the sixth audio signal.

9. The information processing apparatus of claim 8, further comprising:

a third sound image localization apparatus configured to receive a fourth monaural audio signal and output a seventh audio signal and an eighth audio signal.

10. The information processing apparatus of claim 9, wherein the third mixer is configured to mix the first audio signal, the third audio signal, the seventh audio signal, and the output of the third delay circuit and output the fifth audio signal; and the fourth mixer is configured to mix the second audio signal, the fourth audio signal, the eighth audio signal, and the output of the third delay circuit and output the sixth audio signal.

11. The information processing apparatus of claim 10, further comprising:

a fourth sound image localization apparatus configured to receive a fifth monaural audio signal and output a ninth audio signal and a tenth audio signal.

12. The information processing apparatus of claim 11, wherein the third mixer is configured to mix the first audio signal, the third audio signal, the seventh audio signal, the ninth audio signal, and the output of the third delay circuit and output the fifth audio signal; and the fourth mixer is configured to mix the second audio signal, the fourth audio signal, the eighth audio signal, the tenth audio signal, and the output of the third delay circuit and output the sixth audio signal.

13. The information processing apparatus of claim 12, further comprising:

a fifth sound image localization apparatus configured to receive a sixth monaural audio signal and output a eleventh audio signal and a twelfth audio signal.

14. The information processing apparatus of claim 13, wherein the third mixer is configured to mix the first audio signal, the third audio signal, the seventh audio signal, the ninth audio signal, the eleventh audio signal, and the output of the third delay circuit and output the fifth audio signal; and the fourth mixer is configured to mix the second audio signal, the fourth audio signal, the eighth audio signal, the tenth audio signal, the twelfth audio signal, and the output of the third delay circuit and output the sixth audio signal.

15. A method performed by an information processing apparatus, the method comprising:

receiving, at a first head related transfer function (HRTF) filter, a monaural audio signal and generating a first channel output signal using a first head related transfer function describing a change in sound at a right eardrum caused when a sound occurs from a first direction;

receiving, at a second HRTF filter, the monaural audio signal and generating a second channel output signal using a second head related transfer function describing a change in sound at a left eardrum caused when a sound occurs from the first direction;

cutting, by a first low-pass filter, high frequency components of the monaural audio signal and passing low frequency components of the monaural signal;

delaying, by a first delay circuit, an output of the first low-pass filter by a first delay amount;

cutting, by a second low-pass filter, high frequency components of the monaural audio signal and passing low frequency components of the monaural signal;

delaying, by a second delay circuit, an output of the second low-pass filter by a second delay amount;

mixing, by a first mixer, an output of the first HRTF filter and an output of the first delay circuit and output a first audio signal; and mixing, by a second mixer, an output of the second HRTF filter and an output of the second delay circuit and output a second audio signal, wherein a difference between the first delay amount and the second delay amount is set such that a second direction of localization caused by the difference between the first delay amount and the second delay amount coincides with the first direction of the first HRTF filter and the second HRTF filter.

* * * * *